US005467109A

United States Patent [19]

Nagaoka

[11] Patent Number: 5,467,109

[45] Date of Patent: Nov. 14, 1995

[54] CIRCUIT FOR GENERATING DATA OF A LETTER TO BE DISPLAYED ON A SCREEN

[75] Inventor: Hideo Nagaoka, Tokyo, Japan

[73] Assignee: NEC Corporation, Tokyo, Japan

[21] Appl. No.: 229,106

[22] Filed: Apr. 18, 1994

Related U.S. Application Data

[63] Continuation of Ser. No. 950,756, Sep. 24, 1992, abandoned, which is a continuation of Ser. No. 570,075, Aug. 20, 1990, abandoned.

[30] Foreign Application Priority Data

Aug. 18, 1989 [JP] Japan ..... 1-212278

[51] Int. Cl.[6] ..... G09G 1/16

[52] U.S. Cl. ..... 345/194; 345/141; 345/26

[58] Field of Search ..... 345/141, 25, 26, 345/194; 395/110; 340/815.01

[56] References Cited

U.S. PATENT DOCUMENTS

| | | | |
|---|---|---|---|
| 3,685,038 | 8/1972 | Flanagan | 340/703 |
| 3,911,418 | 10/1975 | Takeda | 340/750 |
| 4,139,838 | 2/1979 | Inose et al. | 340/703 |
| 4,232,311 | 11/1980 | Agneta | 340/703 |
| 4,734,619 | 3/1988 | Havel | 340/701 |
| 4,788,535 | 11/1988 | Chikara et al. | 340/701 |
| 5,195,180 | 3/1993 | Takakura et al. | 340/703 |

FOREIGN PATENT DOCUMENTS

| | | |
|---|---|---|
| 0108516 | 10/1983 | European Pat. Off. . |
| 0288934 | 4/1988 | European Pat. Off. . |

OTHER PUBLICATIONS

"Attribute Memory for Display Adapter" J. D. Landers, Jr. IBM Technical Disclosure Bulletin vol. 27, No. 4A, Sep. 1984.

*Primary Examiner*—Ulysses Weldon
*Assistant Examiner*—Amare Mengistu
*Attorney, Agent, or Firm*—Sughrue, Mion, Zinn, Macpeak & Seas

[57] ABSTRACT

A display having a letter portion and a background portion is displayed on a screen. One of the letters and backgrounds portion is displayed with a first color designated by color data stored in a memory, and the remaining one thereof is displayed with a second color which is determined by data obtained by inverting data of the first color.

3 Claims, 5 Drawing Sheets

FIG. 5

| COLOR DATA Scc | | | LETTER COLOR | BACKGROUND COLOR |
|---|---|---|---|---|
| SccR | SccG | SccB | | |
| 0 | 0 | 0 | BLACK | WHITE |
| 1 | 0 | 0 | RED | CYAN |
| 0 | 1 | 0 | GREEN | MAGENTA |
| 1 | 1 | 0 | YELLOW | BLUE |
| 0 | 0 | 1 | BLUE | YELLOW |
| 1 | 0 | 1 | MAGENTA | GREEN |
| 0 | 1 | 1 | CYAN | RED |
| 1 | 1 | 1 | WHITE | BLACK |

CIRCUIT FOR GENERATING DATA OF A LETTER TO BE DISPLAYED ON A SCREEN

This is a Continuation of application Ser. No. 07/950,756 filed Sep. 24, 1992 which is a Continuation of U.S. application Ser. No. 07/570,075 filed Aug. 20, 1990 both now abandoned.

FIELD OF THE INVENTION

This invention relates to a circuit for generating data of a letter to be displayed on a screen, and more particularly, to a circuit for generating data of a letter to be displayed on a screen, and color-data of the letter and a background to be displayed along with the letter.

BACKGROUND OF THE INVENTION

A circuit for generating data of a letter to be displayed on a screen is widely used to display a number, a symbol, an alphabetical letter, etc. (simply called a "letter" hereinafter) which are superimposed on a video image displayed on a CRT screen of a raster scan type. A typical example of such a letter is a channel number, etc. displayed on a video image which has been displayed on a CRT screen of a television set.

A conventional circuit for generating data of a letter comprises a character memory for storing data of letters to be displayed, and a video memory for temporarily storing an address of the character memory to be accessed. In this circuit, predetermined address information is written into the video memory to access the character memory, so that data of a letter to be displayed is read from the character memory by the address information. The data of the letter read from the character memory is supplied to a display circuit including a CRT screen, so that at least one letter is displayed at a predetermined position on the CRT screen by superimposing the data of the letter on data of a video image at a predetermined time or by replacing a portion of the video image data with the letter data.

In such a conventional circuit for generating data of a letter, it is required in recent years that a letter selected from a plurality of letters is displayed in a predetermined color which is different from that of the remaining letters. It is also required that a background of the displayed letter selected from plural backgrounds is displayed in a predetermined color which is different from that of the displayed letter, and from those of the remaining backgrounds. For this purpose, it is necessary that a memory for storing data designating a color of a letter to be displayed and data designating a color of a background corresponding to the letter is provided.

However, where such a memory is provided to realize the purpose described above, a disadvantage occurs in that the storage capacity of a memory is increased to result in the increase in chip area of an integrated circuit necessary for generating data of a letter. As an occupied area of the memory is increased, space considerations in for instance, a television set, prevent other functions from being added thereto. This disadvantage becomes considerable, as the number of letters to be stored is increased.

SUMMARY OF THE INVENTION

Accordingly, it is an object of this invention to provide an improved circuit for generating data of a letter to be displayed on a screen.

It is a further object of this invention to provide a circuit for generating data of a letter to be displayed on a screen, in which data for a color of a letter to be displayed, and for a color of a background corresponding to the letter are generated.

According to this invention, a circuit for generating data of a letter to be displayed on a screen comprises a first memory for storing data of a plurality of letters each including a letter portion and a background portion, means for reading data of at least one letter to be displayed from the first memory, a second memory for temporarily storing color data for a portion selected from the letter portion and the background portion of the letter, and means connected to the first and second memories for generating a letter color signal indicative of a predetermined color in response to the letter portion of the letter and the color data, and a background color signal indicative of a color different from the predetermined color in response to the background portion of the at least one letter and the color data.

In the circuit for generating data of a letter according to this invention, the letter portion and the background portion have different information from each other among data of the plurality of letters stored in the first memory, and the color data is used commonly for the letter portion and the background portion to generate different color signals for the letter and background portions.

Therefore, the necessity of storing both data designating a letter color and a background color is eliminated. Thus, either one of the letter color or the background color is stored to decrease a necessary storage capacity of a memory. This provides the decrease of an occupied area of the memory on a chip for the circuit for generating data of a letter of this invention.

In a preferred embodiment of this invention, a letter color and a background color have a relation of complementary colors. Color data are of, for instance, three bit signals corresponding to red, blue, and green to designate eight colors. Where color data of a letter portion is stored in a memory, the color data is used to determine a color of the letter portion, when the letter portion is read from a memory. Otherwise, a complementary color relative to the color of the letter portion is used for a color of the background portion. The complementary color is based on data which is obtained by inverting all bits of the color data of the letter portion. Consequently, the contrast between a letter and a background displayed on a screen is made clear.

BRIEF DESCRIPTION OF THE DRAWINGS

This invention will be explained in more detail in conjunction with appended drawings, wherein:

FIG. 5 is an explanatory diagram showing a relation between letter and background colors based on color data.

DESCRIPTION OF THE PREFERRED EMBODIMENT

Figure 1:
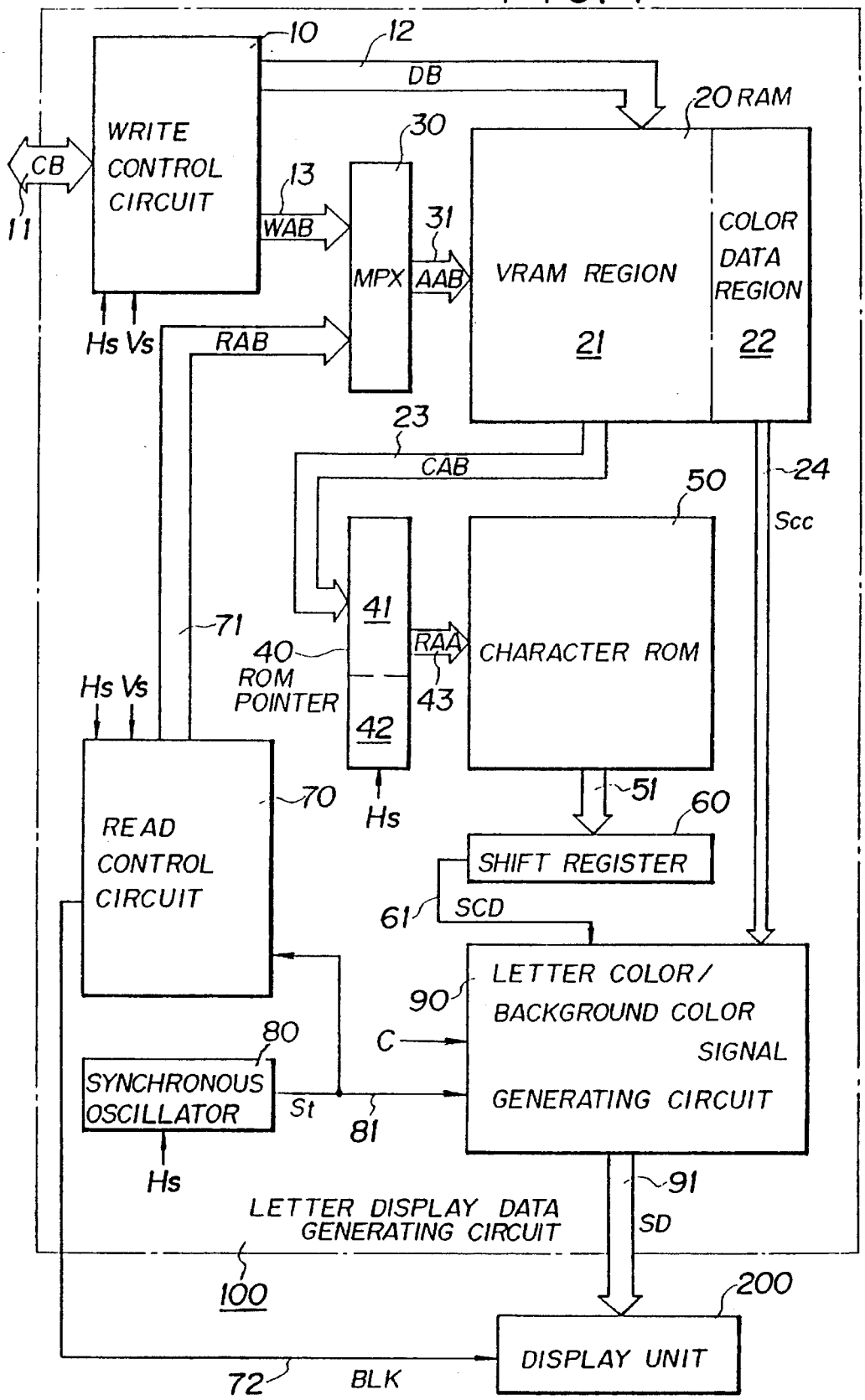
FIG. 1 is a block diagram showing a circuit for generating data of a letter to be displayed on a screen in a preferred embodiment according to this invention.

FIG. 1 shows a circuit for generating data of a letter to be displayed on a screen in the preferred embodiment according to this invention. This circuit 100 has a character ROM 50 for storing data corresponding to a plurality of letters which can be displayed on a CRT screen of a display unit 200. Among the letters, at least one letter is selected to be displayed by command data supplied through a command bus 11 from an external controller (not shown). The command data includes information of a letter to be displayed and information designating a color of the letter, and is transferred to a write control circuit 10. In this write control circuit 10, start address information of a memory region of the character ROM 50 storing a letter to be displayed and color data corresponding to the letter are generated, and supplied through a data bus 12 to a RAM (Random Access Memory) 20. For the writing of the supplied data, an address of the RAM 20 is designated by address information supplied through a write address bus 13, a multiplexer 30, and an access address bus 31 from the write control circuit 10. The RAM 20 includes a VRAM (Video RAM) region 21, to which the start address information is written, and a color data memory region 22, to which the color data are written. The write control circuit 10 is supplied with a horizontal synchronous pulse Hs and a vertical synchronous pulse Vs from the display unit 200, and controls the RAM 20 to store data of following display in place of formerly stored data during horizontal and/or vertical retrace periods. Thus, a letter and a color to be displayed are designated.

On the other hand, the RAM 20 is also controlled by a read control circuit 70, so that data is read from the RAM 20. The read control circuit 70 provides a predetermined timing signal in accordance with the horizontal and vertical synchronous pulses Hs and Vs, and a clock signal St generated to be synchronous with the horizontal synchronous pulse Hs by a synchronous oscillator 80.

The RAM 20 is accessed by address information supplied through a read address bus 71, the multiplexer 30, and the access address bus 31 from the read control circuit 70. The start address information is read at an accessed address from the VRAM region 21, while the color data are read at an accessed address from the color data region 22. The start address information thus read from the VRAM region 21 is supplied through a data bus 23 to an upper bit region 41 of a ROM pointer 40, and is latched therein. In this preferred embodiment, the VRAM region 21 has a width of eight bits, and the character ROM 50 has addresses each having twelve bits. A lower bit region 42 of the ROM pointer 40 is of four bits which are incremented by receiving the horizontal synchronous pulse Hs. Address information is supplied from the ROM pointer 40 to the character ROM 50, from which data corresponding to one horizontal scanning period among data of a letter to be displayed are read in parallel. In this preferred embodiment, each of letters stored in the character ROM 50 has a width of seven bits and a height of nine bits. This means that data of seven bits are read from the character ROM 50 to be supplied through a data bus 51 to a shift register 60, in which the seven bit data are latched to be supplied to a line 61 one bit by one bit synchronously with a shift clock signal. In the ROM pointer 40, the lower bit region 42 is reset by a reset signal supplied from the read control circuit 70. In addition, the read control circuit 70 supplies the display unit 200 with a blanking signal BLK on a signal line 72 to communicate the conduct of displaying a letter on the CRT screen thereto.

The detail of the write and read control circuits 10 and 70 are not explained here, because these circuits are well known for one skilled in the art, and have no connection with this invention.

Figure 2:
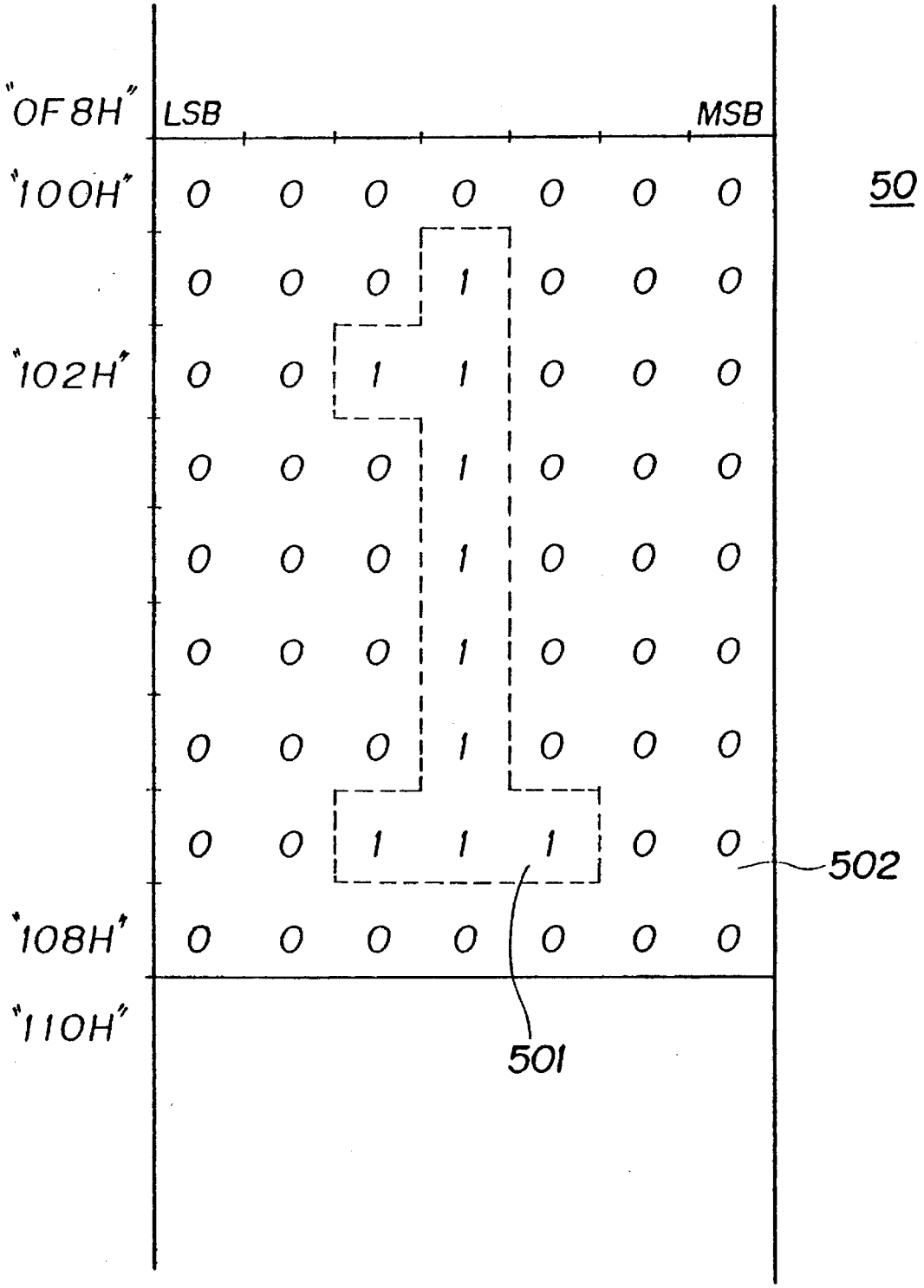
FIG. 2 is a memory map showing a memory region of a character ROM (Reed Only Memory) included in the circuit of FIG. 1.

FIG. 2 shows a memory map addressed from "100H" (H: hexadecinormal digit) to "108H" in the character ROM 50. This memory region is a region having a size of seven bits by nine bits as explained before to define a letter portion 501 and a background portion 502. As clearly illustrated in FIG. 2, data having ten bits of "1" are stored in the letter portion 501, while data having the remaining bits of "0" are stored in the background portion 502. In the same manner, data of the other letters are stored in other regions of the character ROM 50. Here, if it is assumed that address information supplied from the ROM pointer 40 is "102H", data of "0011000" are read from the character ROM 50 to be latched in the shift register 60.

Output data SCD on a signal line 61 of the shift register 60 are supplied to a letter color/background color signal generating circuit 90 together with the color data Scc read from the color data region 22 of the VRAM 20, so that a letter display/color data signal SD having different information between the letter and background portions for a letter to be displayed is generated therein to be supplied through a signal line 91 to the display unit 200.

In the display unit 200, a portion of a video image signal is replaced with the letter display/color data signal SD by the blanking signal BLK, so that at least one letter having a predetermined color and a background having a complementary color relative to the predetermined color are displayed at a predetermined position on the CRT screen of the display unit 200. In this display, the letter color/background color signal generating circuit 90 is controlled as to whether or not the background should have a color by a control signal C, and controlled in timing of supplying the letter display/color data signal SD to the display unit 200 by the clock signal St supplied from the synchronous oscillator 80.

Figure 3:
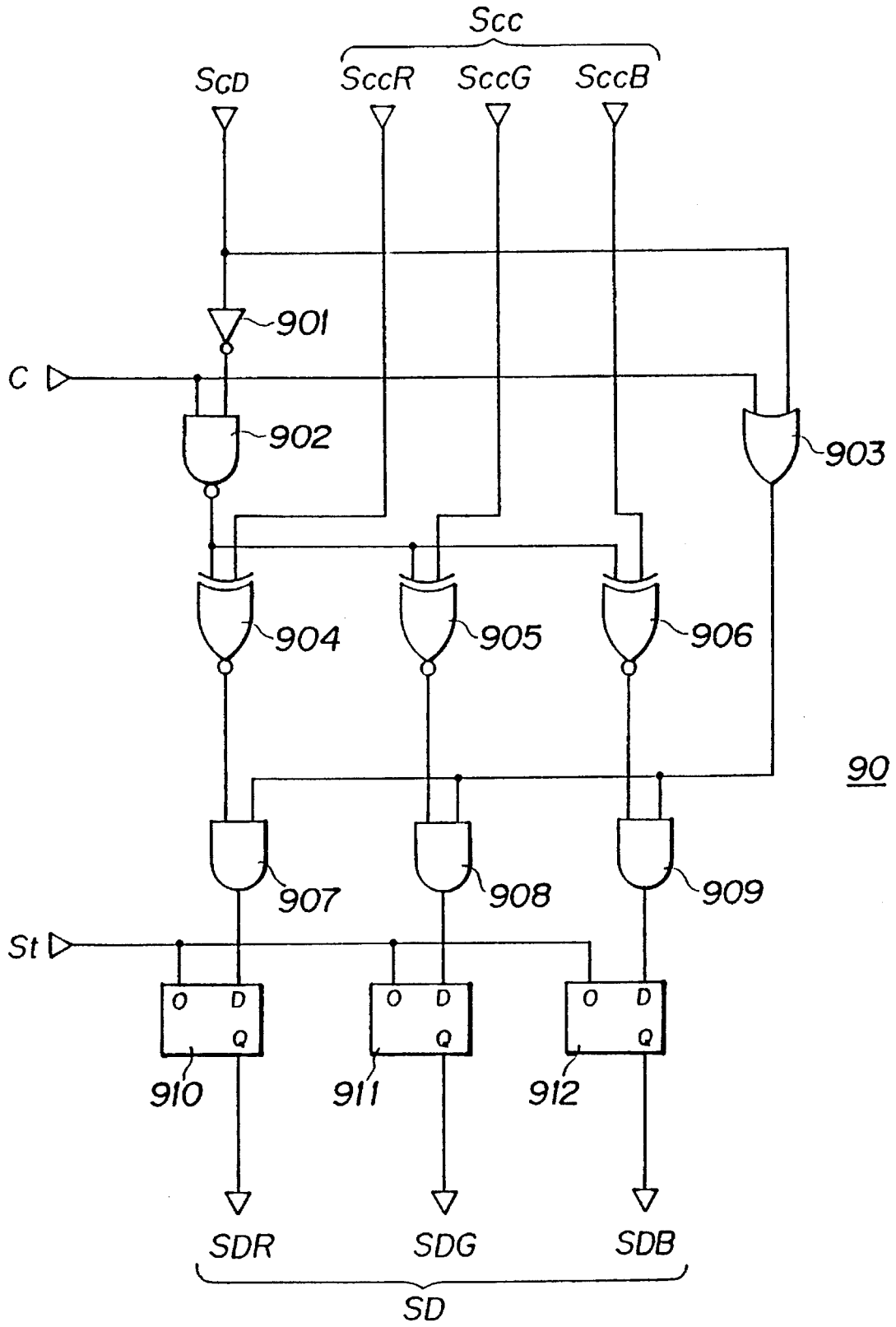
FIG. 3 is a circuitry diagram showing a circuit for generating letter color/background color signals included in the circuit of FIG. 1.

FIG. 3 shows the letter color/background color signal generating circuit 90 comprising an inverter 901, a NAND gate 902, an OR gate 903, three Exclusive-NOR gates 904 to 906, three AND gates 907 to 909, and three D-flip flops 910 to 912 which are connected to each other as shown therein. In this preferred embodiment, the color data Scc are of three bits corresponding to red SccR, green SccG, and blue SccB, respectively. In compliance with the color data Scc, output data SD supplied to the display unit 200 are of three bits corresponding to red SDR, green SDG, and blue SDB, respectively, so that eight kinds of colors can be designated.

Figure 4B:
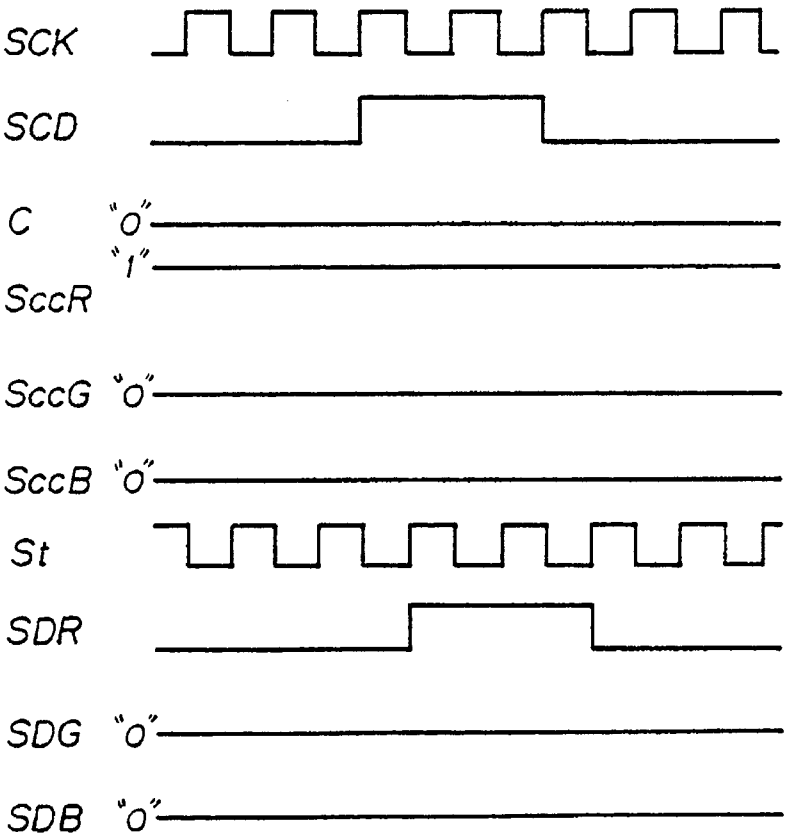
FIGS. 4A and 4B are timing charts showing operation of the circuit of FIG. 1.
Figure 4A:
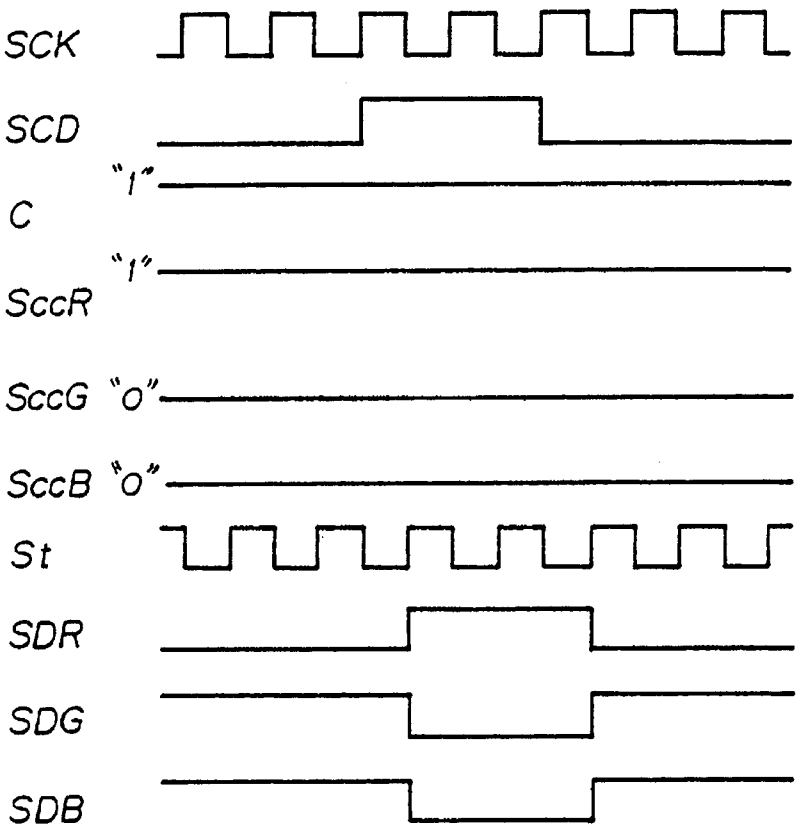

In operation, when the control signal C which is applied to the letter color/background color signal generating circuit 90 is "1", as shown in the timing chart of FIG. 4A, a predetermined color is given to a background to be displayed. Therefore, an output of the OR gate 903 is "1". If it is assumed that a color of a letter designated by a color data Scc is red, color component signals SccR, SccG and SccB of the color data Scc are "1", "0", and "0", respectively, as shown in FIG. 5. Where the address information supplied from the ROM pointer 40 is "102H", the data "0011000" are latched in the shift register 60, as shown in FIG. 2. Then, the data are supplied from the shift register 60 via the signal line 61 to the letter color/background color generating circuit 90 one bit by one bit in the order of LSB to MSB as the signal SCD synchronously with the shift clock signal SCK. As a result, the shift output SCD having a waveform as shown in FIG. 4A is obtained. When the shift output SCD is "0", an output of the NAND gate 902 is "0", so that inverted output signals "0", "1" and "1" are supplied in regard to the color component signals SccR, SccG, and SccB of "1", "0" and "0" from the Exclusive-NORs 904, 905 and 906 respectively. On the other hand, when the shift output SCD is "1", an output signal of the NAND gate 902 is "1", so that the color component signals SccR, SccG and SccB of "1", "0", and "0" are supplied from the Exclusive-NORs 904, 905 and 906 without any signal inversion. Thus, signals SDR, SDG and SDB having waveforms as shown in FIG. 4A are supplied from the circuit 90 via the data bus 91 to the display unit 200. Consequently, the latter portion 501 of the letter is displayed on the CRT display by red, while the background 502 thereof is displayed thereon by cyan which is a complementary color of red. Therefore, a color of a letter to be displayed, and a color of a background which is a complementary color of the letter color can be displayed on the CRT display only by color data Scc designating the letter color. As described above, since data of colors are set in the color data region 22 of the RAM in accordance with letters to be displayed, a letter can be displayed by a color different from those of other letters, and a background can be also displayed by a color different from that of the displayed letter and those of other backgrounds.

On the contrary, where no color is given to a background, the control signal C is "0", so that the output of the NAND gate 902 is fixed to be "1". Therefore, only when data of the letter portion 501 are supplied from the circuit 90 to the display unit 200, the output data SD for a color designated by the color data Scc are generated therein. On the other hand, each bit of the output data SD is "0", when data of the background portion 502 are supplied from the circuit 90 to the display unit 200.

In the preferred embodiment, although a color of a letter to be displayed is designated by color data Scc, a color of a background corresponding to the letter may thereby be designated. In this case, the inverter 901 is connected to the OR gate 903 instead of the NAND gate 902. As a matter of course, the bit number of color data, letter data, etc. may be changed.

Although the invention has been described with respect to specific embodiment for complete and clear disclosure, the appended claims are not to be thus limited but are to be construed as embodying all modifications and alternative constructions that may occur to one skilled in the art which fairly fall within the basic teaching herein set forth.

What is claimed is:

1. A circuit for generating color data of a letter to be displayed on a display device, comprising a first memory for storing a plurality of letters each composed of a letter portion defined by a plurality of first bit data each having a binary logic level and a background portion defined by a plurality of second bit data each having binary logic level that is different from the binary logic level of the first bit data, a data output circuit coupled to said first memory and outputting each of said first and second bit data of at least one of said letters in series from said first memory, a second memory for temporarily storing color data for designating a color of one of said letter and background portions of said one of said letters, said color data being composed of a plurality of third bit data for designating said color of said one of said letter and background portions, and a color control circuit having a first input terminal coupled to said data output circuit to receive each of said first and second bit data outputted in series from said first memory, a plurality of second input terminals coupled to said second memory to receive said third bit data from said second memory, a plurality of output terminals of said color control circuit being coupled to said second memory, said color control circuit responding to said third bit data and producing at said output terminals first color data indicative of a first color each time said first input terminal receives said first bit data and second color data indicative of a second color different from said first color each time said first input terminal receives said second bit data, wherein said color control circuit includes a plurality of first gate circuits each having a first input node coupled to said first input terminal, a second input node coupled to an associated one of said second input terminals and an output node coupled to an associated one of said output terminals and transferring an associated one of said third bit data to said output node each time said first input node receives one of said first and second bit data and transferring an inverted data of said associated one of said third bit data to said output node each time said first input node receives the other of said first and second bit data, said first color being thereby complementary to said second color.

2. A circuit for generating color data of a letter to be displayed on a display device, comprising a first memory for storing a plurality of letters each composed of a letter portion defined by a plurality of first bit data each having a binary logic level and a background portion defined by a plurality of second bit data each having a binary logic level which is different from the binary logic level of the first bit data, a data output circuit coupled to said first memory and outputting each of said first and second bit data of at least one of said letters in series from said first memory, a second memory for temporarily storing color data for designating a color of one of said letter and background portions of said one of said letters, said color data being composed of a plurality of third bit data for designating said color of said one of said letter and background portions, and a color control circuit having a first input terminal coupled to said data output circuit to receive each of said first and second bit data outputted in series from said first memory, a plurality of second input terminals coupled to said second memory to receive said third bit data from said second memory, a plurality of output terminals of said color control circuit being coupled to said second memory, said color control circuit responding to said third bit data and producing at said output terminals first color data indicative of a first color each time said first input terminal receives said first bit data and second color data indicative of a second color different from said first color each time said first input terminal receives said second bit data, wherein said color control circuit includes a plurality of first gate circuits each having a first input node coupled to said first input terminal, a second input node coupled to an associated one of said second input terminals and an output node coupled to an associated one of said output terminals and transferring an associated one of said third bit data to said output node each time said first input node receives one of said first and second bit data and transferring an inverted data of said associated one of said third bit data to said output node each time said first input node receives the other of said first and second bit data, said first color being thereby complementary to said second color, wherein each of said gate circuits is an exclusive NOR gate circuit.

3. A circuit for generating color data of a letter to be displayed on a display device, comprising a first memory for storing a plurality of letters each composed of a letter portion defined by a plurality of first bit data each having a binary logic level and a background portion defined by a plurality of second bit data each having a binary logic level which is different from the binary logic level of the first bit data, a data output circuit coupled to said first memory and outputting each of said first and second bit data of at least one of said letters in series from said first memory, a second memory for temporarily storing color data for designating a color of one of said letter and background portions of said one of said letters, said color data being composed of a plurality of third bit data for designating said color of said one of said letter and background portions, and a color control circuit having a first input terminal coupled to said data output circuit to receive each of said first and second bit data outputted in series from said first memory, a plurality of second input terminals coupled to said second memory to receive said third bit data from said second memory, a plurality of output terminals of said color control circuit being coupled to said second memory, said color control circuit responding to said third bit data and producing at said output terminals first color data indicative of a first color each time said first input terminal receives said first bit data and second color data indicative of a second color different from said first color each time said first input terminal receives said second bit data, wherein said color control circuit includes a plurality of first gate circuits each having a first input node coupled to said first input terminal, a second input node coupled to an associated one of said second input terminals and an output node coupled to an associated one of said output terminals and transferring an associated one of said third bit data to said output node each time said first input node receives one of said first and second bit data and transferring an inverted data of said associated one of said third bit data to said output node each time said first input node receives the other of said first and second bit data, said first color being thereby complementary to said second color, wherein said color control circuit further includes a second gate circuit inserted between said first input terminal and each of said first input nodes of said first gate circuits and supplied with a control signal, said second gate circuit being set in an open state when said control signal takes a first state to transfer each of said first and second bit data to each of said first input nodes of said first gate circuits and said second gate circuit being set in a closed state when said control signal takes a second state to hold each of said first input nodes of said first gate circuits at one of said binary logic levels.

* * * * *